US006241126B1

(12) United States Patent
Goodman

(10) Patent No.: US 6,241,126 B1
(45) Date of Patent: Jun. 5, 2001

(54) PERSONAL DESK TOP BEVERAGE DISPENSER

(76) Inventor: Andrew Goodman, 445 W. 240th St. Apt.# 3C, Bronx, NY (US) 10463

( * ) Notice: Subject to any disclaimer, the term of this patent is extended or adjusted under 35 U.S.C. 154(b) by 0 days.

(21) Appl. No.: 09/458,713

(22) Filed: Dec. 13, 1999

Related U.S. Application Data

(60) Provisional application No. 60/115,352, filed on Jan. 8, 1999.

(51) Int. Cl.[7] ..... B67D 5/06

(52) U.S. Cl. ..... 222/185.1; 222/509

(58) Field of Search ..... 251/231; 222/181.1, 222/185.1, 505, 509

(56) References Cited

U.S. PATENT DOCUMENTS

| | | | | |
|---|---|---|---|---|
| D. 381,857 | | 8/1997 | Swaim | D7/307 |
| 1,032,861 | * | 7/1912 | Powell | 222/185 |
| 1,480,405 | * | 1/1924 | Long et al. | 222/185 |
| 2,464,030 | * | 3/1949 | Engstrom | 222/181.5 |
| 4,189,793 | | 2/1980 | Williamson et al. | 4/228 |
| 4,204,613 | | 5/1980 | Terzian et al. | 222/146 |
| 4,266,695 | * | 5/1981 | Ruperez | 222/185 |
| 4,844,290 | | 7/1989 | McCurdy et al. | 222/185 |
| 4,930,666 | | 6/1990 | Rudick | 222/181 |
| 5,211,314 | | 5/1993 | Burrows | 222/185 |
| 5,356,046 | | 10/1994 | Burke | 222/156 |
| 5,392,957 | | 2/1995 | Parsons | 222/1 |
| 5,427,276 | * | 6/1995 | Knuettel, II et al. | 222/185.1 |
| 5,697,526 | * | 12/1997 | Lee | 222/181.1 |
| 5,791,517 | | 8/1998 | Avital | 222/1 |
| 5,842,606 | * | 12/1998 | DeVito | 222/132 |
| 6,065,694 | * | 5/2000 | Scoggins | 222/181.2 |

FOREIGN PATENT DOCUMENTS

| | | | |
|---|---|---|---|
| 1053062 | 3/1952 | (FR) | 20/4 |
| 2246764 | 2/1992 | (GB) . | |

* cited by examiner

*Primary Examiner*—Kevin Shaver
*Assistant Examiner*—D. Austin Bonderer
(74) *Attorney, Agent, or Firm*—Richard C. Litman

(57) ABSTRACT

An apparatus that serves as a desktop beverage dispenser. The invention is comprised of a base that holds an inverted bottle of a chosen beverage. The bottle of the chosen beverage can be screwed into a concave threaded inlet that is on top of the base. The concave threaded inlet is above the lever and valve assembly within the base. The lever and valve assembly controls the flow of the beverage from the bottle into a desired container such as a cup. The cup is slid into the bottom of the base underneath the lever and valve assembly, where the cup is garaged for the beverage to be dispensed therein.

3 Claims, 2 Drawing Sheets

PERSONAL DESK TOP BEVERAGE DISPENSER

CROSS-REFERENCE TO RELATED APPLICATION

This application claims the benefit of U.S. Provisional Patent Application Ser. No. 60/115,352, filed Jan. 8, 1999.

BACKGROUND OF THE INVENTION

1. Field of the Invention

The present invention relates to a personal desktop beverage dispenser. More specifically, the invention is a small beverage dispenser stand adapted to invertedly receive a standard, commercially-available threaded beverage bottle.

2. Description of Related Art

There are many patents in the related art that describe an apparatus that dispenses beverages. Some of the related art can be categorized into devices that dispense single-serving quantities of beverages. For example, in U.S. Pat. No. 5,791,517, Avital describes a beverage dispensing device that can be used as part of a refrigerator or as a table-top dispenser, wherein an individual bottle is adapted with a dispensing mechanism. McCurdy et al. (U.S. Pat. No. 4,844,290) describes another liquid dispensing apparatus that utilizes an individual bottle dispensing mechanism. Terzian et al. (U.S. Pat. No. 4,204,613) describes a dispensing device for an inverted beverage bottle that also cools the drinking liquid by passing the liquid through an extended length of coiled tubing.

Other patented devices are characterized by those of Rudick (U.S. Pat. No. 4,930,666), which describes an apparatus for dispensing beverages by gravity from a container mounted in the door of a refrigerated cabinet, and, Parsons (U.S. Pat. No. 5,392,957), which shows a dispensing device attached to a liquid container, such as a gallon jug, that utilizes a tilt and pour technique. Various design patents, such as McGinnis et al. (U.S. Pat. No. D339,022), do not physically resemble the dispenser of the present invention.

What is needed is an apparatus that is functionally able to dispense beverages while stationarily situated on a work surface, such as a desktop or tabletop, and that permits a standard, commercially-available, threaded beverage bottle (such as a quart-sized plastic EVIAN bottle) to be received, inverted and selectively operated to dispense a serving of liquid.

None of the above inventions and patents, taken either singly or in combination, is seen to describe the instant invention as claimed.

SUMMARY OF THE INVENTION

The invention comprises a specially adapted base for holding an inverted, threaded bottle of drinking liquid. The top of the base includes a concave threaded inlet which mates with the threaded neck of a bottle of drinking liquid. The bottom of the base forms a stand for elevating the top of the base, the bottom being configured as a garage to receive a desired drinking vessel, such as a cup. Under the concave threaded inlet, a lever and valve assembly is disposed within the base to control the flow of liquid from the bottle into the cup.

Accordingly, it is a principal object of the invention to dispense hot or cold beverages, such as coffee or soda and juice bottles.

Therefore, an object of the invention is to provide a manually transportable water dispenser base that is adapted to receive a standard, commercially available beverage bottle.

Another object of the invention is to provide a dispenser base sized for desktop or tabletop use and adapted to garage a drinking vessel.

It is a further object of the invention to provide a novelty item that is both functional and decorative for tabletop use, reminiscent and simulative of a full-size, office bottled beverage cooler.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
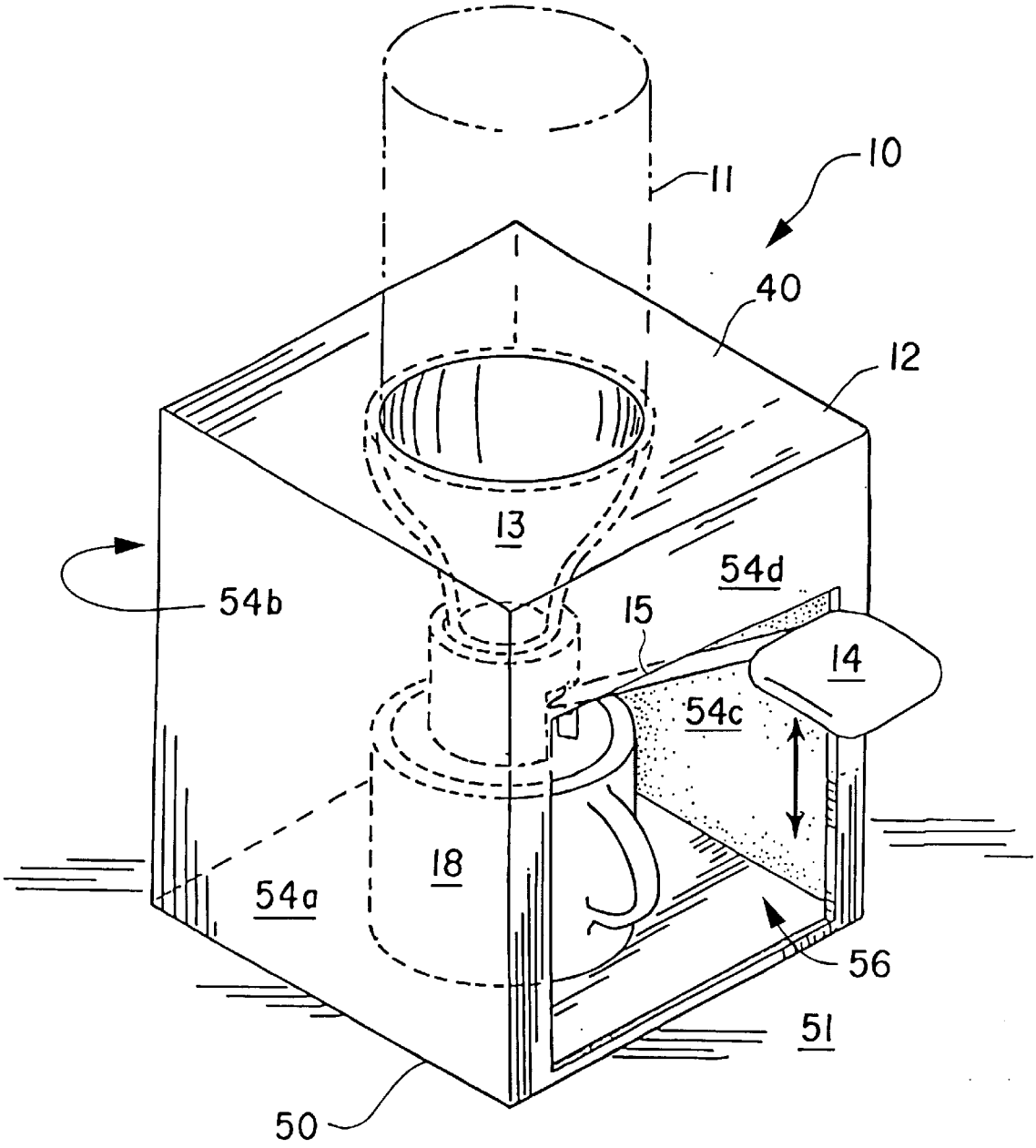
FIG. 1 is an environmental, perspective view of a personal desktop beverage dispenser according to the present invention.

The present invention is a personal desktop beverage dispenser 10. As generally shown in FIG. 1, the personal desktop beverage dispenser 10 is comprised of a a box-shaped base or housing 12, a receiving means for receiving the inverted beverage bottle 11, and a dispensing means for dispensing the beverage 13 from the inverted beverage bottle 11. A cup 18 for receiving the dispensed beverage 13 is positioned below the dispensing means.

The bottom wall 50 of the base 12 comprises a floor which rests on a tabletop or desktop and a plurality of walls 54*a* (left side), 54*b* (rear), 54*c* (right side), 54*d* (front) which support and elevate a top 40 of the base 12. One of the walls 54*d* forms a door opening 56 sized to permit passage of cup 18. The bottom 50 and top 40 are sized and dimensioned to form a garage for storage of the cup 18.

Figure 2:
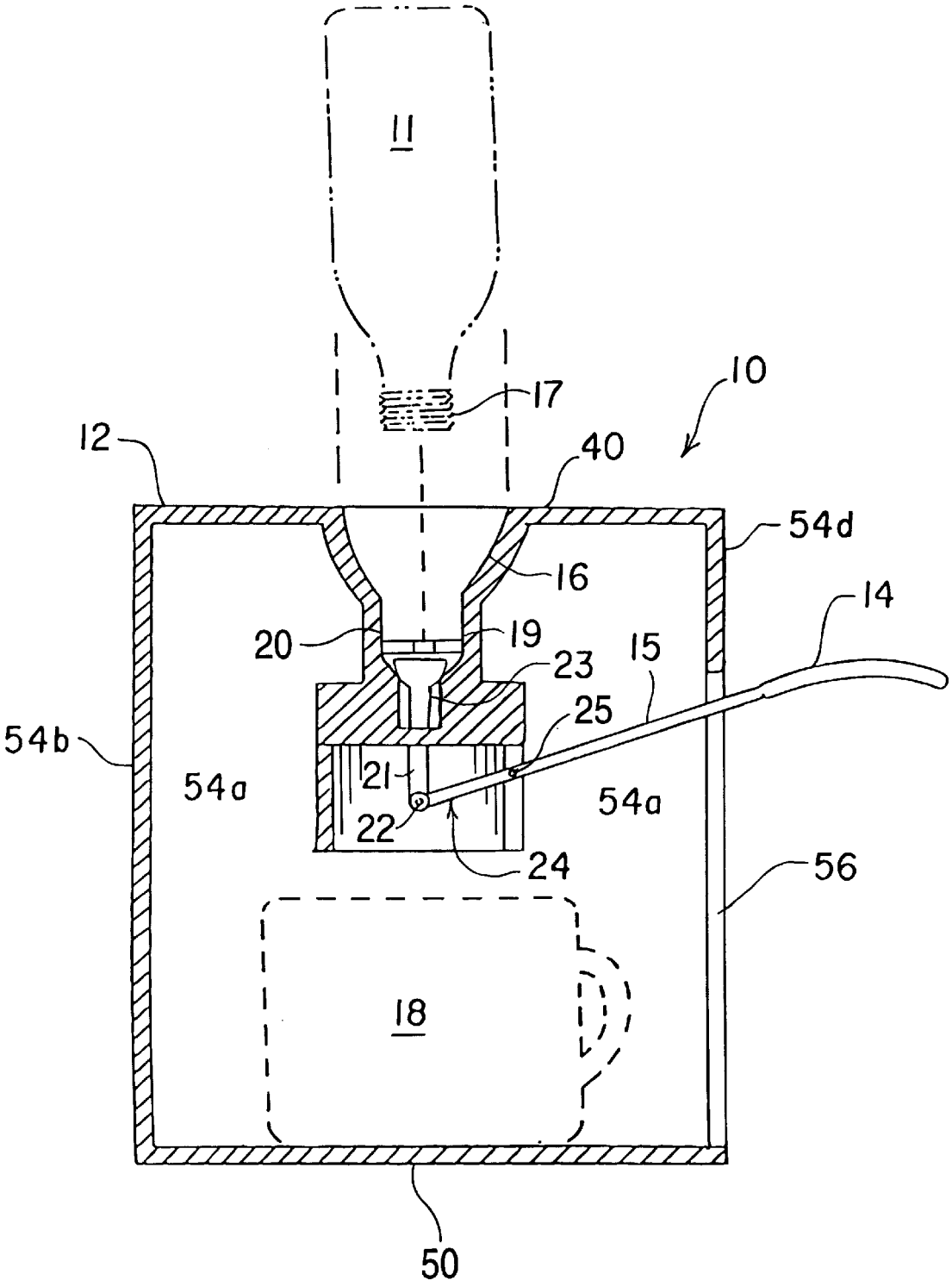
FIG. 2 is an sectional side view of the personal desktop beverage dispenser.

The top 40 of base 12 is concave to receive the neck of an inverted beverage bottle 11. The bottle 11 is of the type having a threaded spout 17 for receiving a threaded cap, typically up to 2 liters, and currently marketed under a variety of brand names, such as Sprite, Coke, Pepsi, etc. The concave portion of the base 16 leads downward into a threaded inlet 19 (FIG. 2), which is the receiving means of the dispenser 10. The threaded inlet 19 is internally threaded to mate with the externally threaded spout 17 of the bottle 11.

The lever and valve assembly 15 is the dispensing means of the dispenser 10. Both the threaded inlet 19 and the lever and valve assembly 15 are housed within the base 12 and disposed so that cup 18 can be easily inserted into the base 12 through opening 56 without interference and underneath the lever and valve assembly 15. The lever and valve assembly 15 includes a threaded collar 20 containing a valve head 23 on a shaft 21 pivoting on a pin 22 from which a flat handle 14 depends on a lever 24 and a fulcrum pin 25. The handle 14 is adapted to dispense beverages 13 from the bottle 11 into the cup 18, and may be adapted from any known valve.

A second embodiment of this invention dispenses beverages from a one gallon jug or container. The second embodiment is in most respects identical to the first, except that it has a different sized concave portion 16, a different-sized threaded inlet 19 and therefore a different-sized base 12 to accommodate up to a one gallon jug. Obviously, it is also to use the invention with any drinking liquid 13, so long as the bottle 11 that holds the drinking liquid 13 has a similar size and shape to a drinking beverage bottle 11. Also, metric equivalents may be used, namely a 1.5 liter or 750 ml bottled beverage. The base 12 is able to receive different configurations of commercial bottles and can also be attached to and be used in combination with an airline serving cart.

The operation of the actual invention is simple. The threaded inlet 19 receives the inverted threaded spout 17 from the bottled beverage 11. The inverted threaded spout 17 is screwed into the threaded inlet 19, and is thereby disposed above the lever and valve assembly 15. The handle 14 of the lever and valve assembly 15 opens and closes the valve which controls the beverage 13 flow into the cup 18.

The lever and valve assembly 15 is usually in a closed position until it is ready for use. The lever and valve assembly 15 can be opened by pressing the handle 14 down, when lever 14 is released the valve 15 returns to a closed position. The filled cup 18 can then be withdrawn from the inside of the base 12 and used as desired. The personal desktop beverage dispenser 10 is designed to allow a person to fill a cup of a chosen beverage 13 using only one hand. A person could maneuver the cup 18 with their fingers and use their thumb to actuate the lever and valve assembly 15, therefore using only one hand to completely dispense a cup 18 of a chosen beverage from the apparatus.

It is to be understood that the present invention is not limited to the sole embodiment described above, but encompasses any and all embodiments within the scope of the following claims.

I claim:

1. A portable desktop liquid dispenser device in combination with a liquid containing bottle having a threaded neck for dispensing into a cup comprising:

a box-shaped housing having planar sides including a top wall, a partial front wall, a rear wall, a right side wall, a left side wall, and a bottom floor for placement on a desktop;

an opening in the partial front wall configured for insertion of a cup;

a circular aperture having a concave base centered in the top wall and ending in a narrowed internally threaded neck portion adapted for threadingly accepting and supporting a threaded neck of the liquid containing bottle;

a cylindrical hollow body abutting the concave base having an upper aperture coincident with said neck portion, an open bottom, and a vertical slot on a side extending through a wall of the hollow body to the open bottom;

a valve body having a hemispherical head, a cylindrical shaft, and a distal end configured with an aperture; and a lever rod pivotable on a cross pin positioned in the vertical slot of the cylindrical hollow body, one end thereof pivoting on a pin attached to the aperture of the valve body's shaft, and the opposite end having a flattened surface serving as a handle;

wherein by having a liquid dispenser available on a desktop, a user by pushing the handle downwards, the lever pushes up the valve to allow the liquid to enter the cup, and by reversing the motion of the handle, the liquid is prevented from flowing down into the cup.

2. The portable desktop liquid dispenser device according to claim 1, including a threaded collar configured to fit within the threaded neck portion of the concave base.

3. The portable desktop liquid dispenser device according to claim 2, including a replaceable threaded collar commensurate in size to accommodate a bottle neck of a bottle having a different capacity.

* * * * *